US008408357B2

(12) United States Patent
Cheung

(10) Patent No.: US 8,408,357 B2
(45) Date of Patent: Apr. 2, 2013

(54) AIR DUCT ATTENUATOR

(75) Inventor: Raymond Cheung, Leamington Spa (GB)

(73) Assignee: Jaguar Cars Limited, Whitley, Coventry (GB)

( * ) Notice: Subject to any disclaimer, the term of this patent is extended or adjusted under 35 U.S.C. 154(b) by 0 days.

(21) Appl. No.: 13/275,830

(22) Filed: Oct. 18, 2011

(65) Prior Publication Data

US 2012/0090915 A1 Apr. 19, 2012

(30) Foreign Application Priority Data

Oct. 19, 2010 (GB) ..... 1017629.5
Feb. 21, 2011 (GB) ..... 1102974.1

(51) Int. Cl.
*E04F 17/04* (2006.01)

(52) U.S. Cl. ..... 181/224; 181/229; 181/212; 181/250; 123/184.53; 123/184.54; 123/184.55; 123/184.56; 123/184.57

(58) Field of Classification Search ..... 181/212, 181/224, 229, 250; 123/184.53, 184.54, 123/184.55, 184.56, 184.57
See application file for complete search history.

(56) References Cited

U.S. PATENT DOCUMENTS

| | | | | |
|---|---|---|---|---|
| 5,349,141 | A | 9/1994 | Horibe et al. | |
| 5,839,405 | A * | 11/1998 | Falkowski et al. | 123/184.57 |
| 6,467,572 | B1 * | 10/2002 | Liu | 181/272 |
| 6,752,240 | B1 * | 6/2004 | Schlagenhaft | 181/249 |
| 6,935,461 | B2 * | 8/2005 | Marocco | 181/270 |
| 7,278,514 | B1 * | 10/2007 | Quigley | 181/256 |
| 7,810,609 | B2 * | 10/2010 | Sikes et al. | 181/250 |
| 7,905,319 | B2 * | 3/2011 | Sullivan | 181/250 |
| 7,934,581 | B2 * | 5/2011 | Kim et al. | 181/250 |
| 2006/0180388 | A1 * | 8/2006 | Brown et al. | 181/250 |

FOREIGN PATENT DOCUMENTS

| | | |
|---|---|---|
| GB | 2389149 | 12/2003 |
| JP | 2000240520 | 9/2000 |

OTHER PUBLICATIONS

UK Search Report for GB1017629.5, dated Jun. 21, 2011, 1 page.

* cited by examiner

*Primary Examiner* — Forrest M Phillips
(74) *Attorney, Agent, or Firm* — Reising Ethington P.C.

(57) ABSTRACT

An attenuator for the air inlet tract of an internal combustion engine comprises an unobstructed tube (4) having a surrounding enclosure (9) divided into a primary chamber (11) in fluid communication with the inlet tube, and a secondary chamber (12) in fluid communication with the primary chamber. Two secondary chambers (12, 13) may be provided. The arrangement can be tuned to attenuate a wide range of frequencies.

18 Claims, 5 Drawing Sheets

AIR DUCT ATTENUATOR

The present invention relates to an attenuator for an air duct and particularly, but not exclusively, the air intake duct of an internal combustion engine of a vehicle. Aspects of the invention relate to an attenuator, to an apparatus, to an engine and to a vehicle.

Vehicle engines require filtered intake air in order to minimize wear of the moving parts of the engine. Typically an air filter box is mounted at a distance from the engine inlet manifold, and in consequence a closed duct is required to pipe clean air from the air filter box to the engine. The size, shape and routing of this duct is determined by the maximum engine air flow requirement, and by space and packaging requirements for other engine bay equipment.

Air flow confined in the supply duct tends to generate noise and may also generate vibration of the vehicle structure via mountings of the duct. The frequency range of such noise and vibration tends to be wide, and at certain frequencies the air in the duct and/or the duct itself may resonate so as to amplify noise and vibration.

Noise and vibration associated with the engine air intake can be noticeable to occupants of the vehicle, and it would be desirable to provide attenuation, particularly below 2000 Hz. Insulation and muffling provide one possible solution, but the increase in overall duct size may be difficult to accommodate in a congested engine bay. It may be impossible to insulate the duct over the entire length thereof, and furthermore loose materials within the duct are undesirable because of the risk of being ingested by the vehicle engine.

Another solution is to eliminate noise and vibration by better design of the supply duct, and for that purpose tuned quarter-wave and Helmholtz-type resonators have been used to provide attenuation over a narrow frequency band, particularly at a frequency where resonance occurs.

Several quarter-wave or Helmholtz resonators might be used to provide attenuation over several narrow frequency bands, but available engine bay space is limited and so this may not be a practicable possibility especially since each such resonator tends to have a significant volume.

What is required is a compact device for attenuating noise and vibration over a wide frequency band, which is economical to manufacture, and which can provide an aesthetically acceptable under-bonnet appearance. Furthermore this compact device should be susceptible of tuning without substantial change of overall size and position within the engine bay, and preferably be suitable for all configurations of gasoline and diesel engines having between four and eight cylinders.

It is an aim of the present invention to address one of more of these issues. Embodiments of the invention may provide an attenuator for a fluid duct that achieves effective broadband attenuation of noise and vibration induced in an inlet duct in a compact package. Other aims and advantages of the invention will become apparent from the following description, claims and drawings.

Aspects of the invention therefore provide an attenuator, an engine and a vehicle, in accordance with the appended claims.

According to an aspect of the invention for which protection is sought, there is provided an apparatus for attenuating noise and/or vibration in a fluid duct, the apparatus comprising a tube having a wall, an inlet and an outlet, an enclosure surrounding the tube, and at least one baffle dividing the enclosure into a first, or primary, chamber on one side of said baffle, and a second, or secondary, chamber on the other side of said baffle, wherein the interior of the tube is in fluid communication with the primary chamber via an aperture in the tube wall, and the secondary chamber is in communication with the primary chamber via an opening in the baffle.

In this specification the terms 'aperture' and 'opening' is used as a convenient way to distinguish between passages of the tube wall and of the baffle—no limitation of shape, size or appearance is intended. Similarly, the terms "primary" and "secondary" are not intended to imply any particular characteristics such as size, position or relative functional importance, or to be limiting in any way, and the terms "first" and "second" may equally be used.

In an embodiment, the primary and secondary chambers are closed, apart from the aperture and opening. A plurality of apertures and/or a plurality of openings may be provided.

The attenuator of the invention comprises primary and secondary chambers in series, and has been shown to give an effective broadband attenuation of noise and vibration induced in an inlet duct, particularly in the range 500-2000 Hz. This attenuator is compact and typically, but not essentially, comprises a circular or oval section enclosure generally co-axially provided about a straight section of air inlet duct. Circular or oval sections are considered to provide optimum performance. However, substantially any other cross-sectional shape is possible, such as square, rectangular, hexagonal etc., and the inlet duct and enclosure may be substantially non-coaxial.

A particular feature of the invention is that the attenuator has many adjustable parameters which permits tuning of the broadband response within the permitted installation envelope, and by adjustment of the internal components thereof. The attenuator of the invention has shown promise with engines in the 4-8 cylinder range, and is considered to be useful for all gasoline and diesel engines having multiple cylinders.

Thus the external diameter and length of the enclosure is selectable, along with the ratio of the transverse dimensions of the tube and enclosure. The external shape of the enclosure may vary along the length thereof, for example a continuous narrowing from one end.

Within the attenuator the length of tube corresponding to the primary chamber is selectable, and thus the relative axial dimensions of the primary and secondary chambers. Furthermore the area and number of the apertures and openings is selectable.

In an embodiment, the openings are substantially equi-spaced, for example, equi-angularly spaced, about the tube.

In one embodiment the baffle is substantially orthogonal to the flow direction of the inlet duct, so that the apertures are generally radial, and the openings are generally axial with respect to the flow direction.

In one embodiment, a second baffle is provided so as to give two secondary chambers, one on either side of the primary chamber. The secondary chambers may have different volumes, for example by providing for the same cross-sectional area but with different axial dimension. The number and size of openings to each such secondary chamber may be different. It will be appreciated that the attenuator of the invention allows a wide variation of internal configuration.

In another embodiment two primary chambers may be provided, each having a secondary chamber associated therewith. Preferably the two secondary chambers are adjacent, and separated by a solid wall.

The enclosure may be of any suitable cross-sectional profile, but is typically circular or oval, and generally co-axial about the inlet duct. The baffle(s) and solid wall (if provided) are preferably arranged in parallel planes. If desired the enclosure may taper toward one end. In an embodiment with two secondary chambers, a tapered design can provide for secondary chambers of different volume but the same length. A tapered enclosure can also provide two primary chambers of different volume but the same length.

The attenuator may be arranged to be inserted in the fluid duct to replace a section thereof. In this case, the inlet and outlet of the tube may be arranged to sealingly couple with adjacent portions of the fluid duct. The tube may be integrally or unitarily formed with the enclosure.

In an alternative embodiment, the attenuator may be arranged to surround an existing section or portion of the fluid duct which does not form part of the attenuator proper.

According to yet another aspect of the invention for which protection is sought, therefore, there is provided an attenuator for a fluid duct, the attenuator comprising an enclosure arranged to substantially surround the fluid duct, and a baffle dividing the enclosure into primary and secondary chambers, wherein a primary chamber is in fluid communication with the interior of the fluid duct via apertures in the wall of the fluid duct, and a secondary chamber is in communication with the primary chamber via openings in the baffle. Two secondary chambers may be provided in conjunction with a single primary chamber, or a respective primary chamber.

In an embodiment, the enclosure may consist of two halves arranged to surround the fluid duct. The two halves may be hinged together at one edge thereof, in a clamshell type arrangement, and adapted to be clamped around the duct and fastened together at the opposite edge thereof.

Alternatively, the two halves may be independent and clamped together around the duct by suitable fastenings. Such fastenings may be formed integrally with the attenuator halves, or may consist of separate clamping devices such as straps, ties or worm drive type clips.

In this embodiment, the required apertures must be formed in the wall of the fluid duct prior to installation of the enclosure around the duct.

In another embodiment a tubular shell may comprise the enclosure, and have inserted therein an unitary component comprising fluid duct and baffles. One end wall may be provided by the enclosure, and the other by the unitary component so that upon insertion a closed enclosure is formed. The end wall of the unitary component may be fixed to the enclosure in any suitable substantially air-tight manner. Preferably the shell is tapered, the unitary assembly being inserted from the large diameter end.

In embodiments of the invention, the or each primary chamber generally constitutes a resonator for attenuation of high frequencies, whereas the or each secondary chamber constitutes a resonator for attenuation of low frequencies.

Within the scope of this application it is envisaged that the each and every aspect, embodiment, example, feature and alternative set out in the preceding paragraphs, in the claims and/or in the following description and drawings may be taken independently or in any combination thereof. Features described in association with one embodiment of the invention are equally applicable to other embodiments, except where there is incompatibility of features.

The present invention will now be described, by way of example only, with reference to the accompanying drawings in which.

Figure 1:
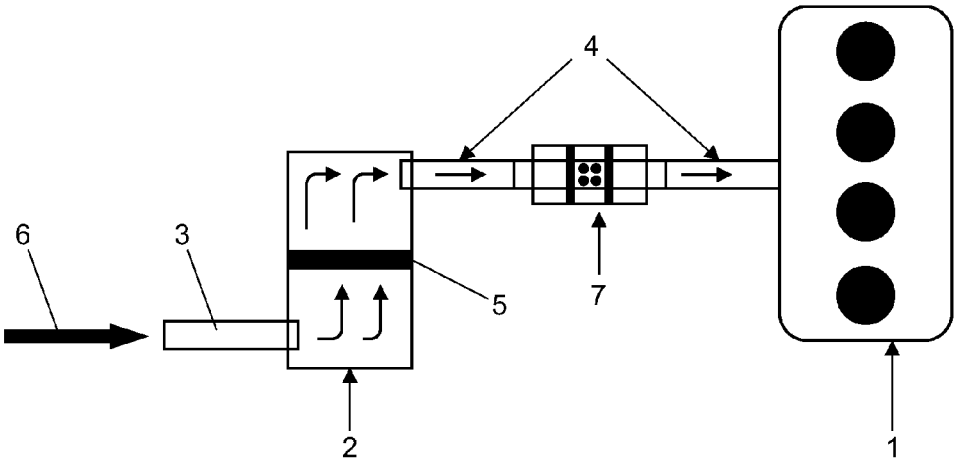
FIG. 1 is a schematic representation of an air inlet tract of the internal combustion engine of a vehicle.

FIG. 1 illustrates schematically the air intake arrangement for an internal combustion engine (1), and comprising an air filter box (2) having an inlet duct (3), a supply duct (4) and a filter element (5). Unfiltered air, indicated by arrow (6), passes through the filter element (5) to the inlet parts of the engine via the supply duct (4). Within the supply duct (4), an attenuator (7) is provided to attenuate noise and vibration.

Figure 2:
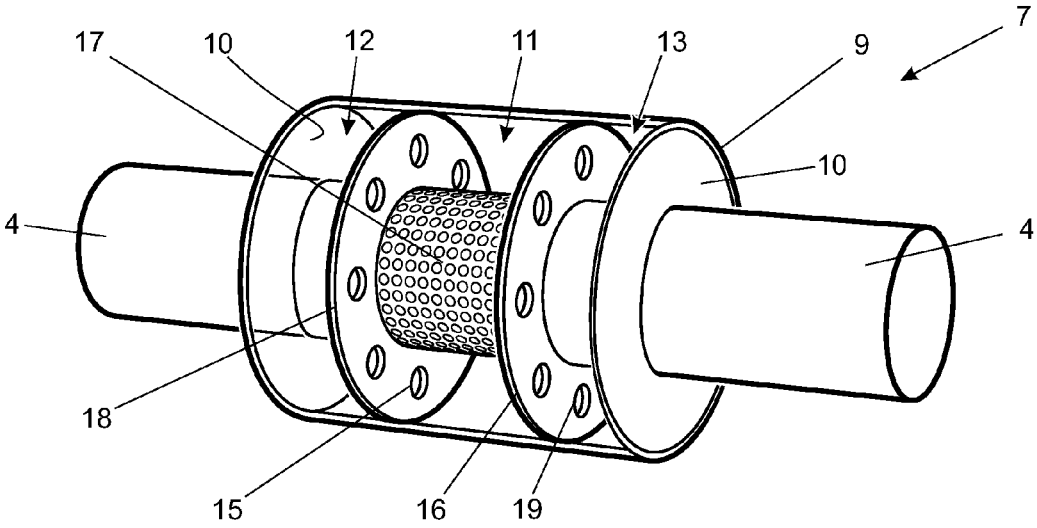
FIG. 2 is a perspective view through a first embodiment of an attenuator according to the invention.

FIG. 2 shows an example of the attenuator (7) in greater detail. The supply duct (4) passes through the attenuator without obstruction, so that air flow is not physically impeded. The attenuator of this embodiment comprises a tubular drum (9) co-axial with the supply duct, which for the purposes of illustration is circular in section. The drum has orthogonal end plates (10) and is divided internally into three chambers (11, 12, 13) by two annular baffles (16, 18). As noted above a single baffle embodiment is also envisaged.

The supply duct (4) communicates with the central chamber (12) via apertures (17), and the central chamber (12) communicates with the end chambers (12, 13) via openings (15, 19). The chambers (11, 12, 13) are closed, apart from the apertures and openings (15, 17, 19), and provide multiple resonators susceptible of tuning to give broadband attenuation of noise and vibration.

Figure 3:
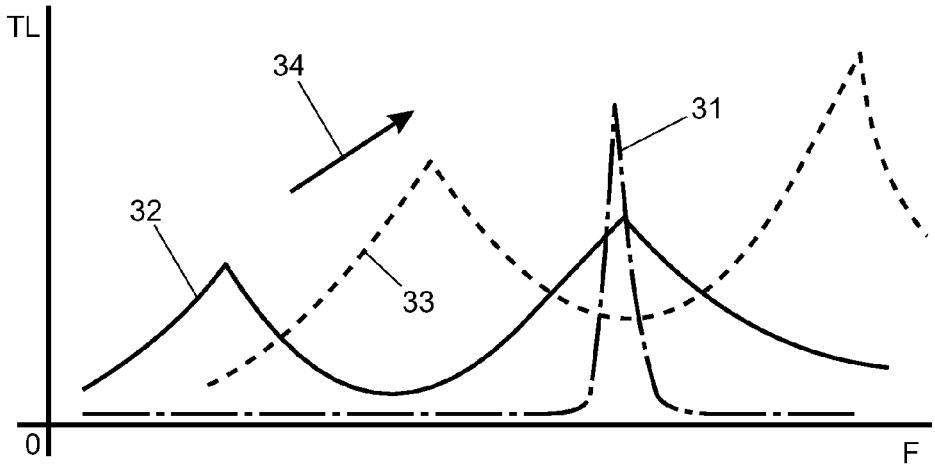
FIGS. 3-5 show graphically the effect of embodiments of the invention.
Figure 4:
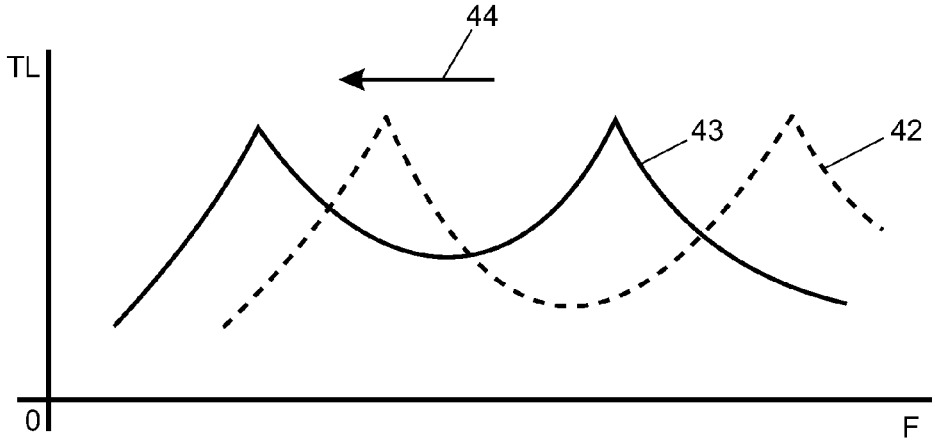
Figure 5:
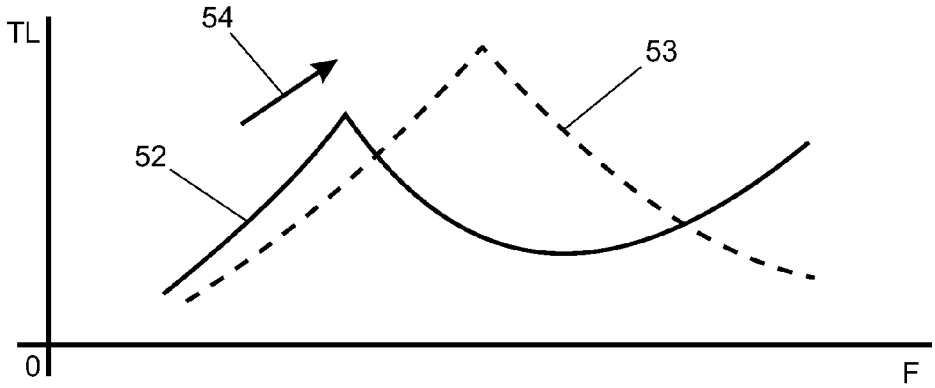

Design variables provides in this embodiment comprise:

axial length of each chamber
external diameter of the chamber
diameter of the supply duct
perforated length of the supply duct
perforation size for the supply duct
perforation number for the supply duct
perforation size for the baffles
perforation number for the baffles FIGS. 3-5 show some of the effects of changing one or more adjustable parameters of the attenuator in order to best attenuate certain noise and vibration frequencies within the inlet air duct. All of these figures show graphs of transmission loss (TL) plotted against frequency (F). The frequency range is approximately 0-2000 Hz, and transmission loss in the range 0-40 dB. The invention provides good attenuation in the frequency range 500-2000 Hz, which has hitherto been difficult to provide in a compact device.

With reference to FIG. 3, for comparison purposes, the line 31 represents the narrow band attenuation provided by a quarter-wave resonator of conventional construction—typically a closed pipe orthogonal to the inlet duct and having a length 3-5 times the diameter of the inlet duct.

A resonator of the general shape of FIG. 2, with two second chambers, has a circular inlet duct with a flow diameter of 57.6 mm, and a circular co-axial enclosure with an internal diameter of 115.2 mm. The primary chamber and each secondary chamber has an axial length of 50 mm. Baffle perforation holes are provided of 10 mm diameter, and by increasing the number of such perforations, the frequency response of the resonator can be shifted up and to the right as indicated by lines (32, 33), and directional arrow (34).

FIG. 4 shows the effect in a resonator of the same shape and size, of increasing the axial length of the secondary chambers, with a fixed number of baffle perforations. The response of the resonator is shifted to the left with increasing length, as indicated by lines (42, 43), and arrow (44).

FIG. 5 shows the effect of changing from a single baffle to a dual baffle construction, the total axial length of secondary chamber being unchanged. In this case the response is shifted up and to the right by adopting a dual baffle, as represented by lines (52) and (53) and arrow (54).

Figure 6:
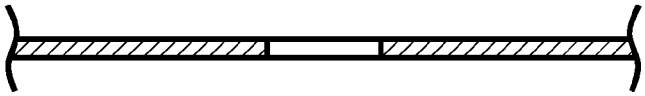
FIGS. 6-7 illustrate different aperture shapes for embodiments of the invention.
Figure 7:
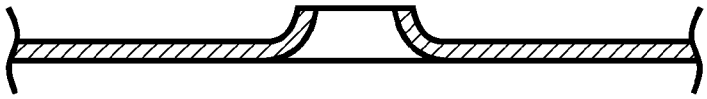

It will be appreciated that there are numerous possibilities for changing parameters, as noted above, and for changing other features such as the shape and form of the apertures in the tube wall and the openings in the baffle(s). For example the apertures may be in the form of simple holes (FIG. 6) or have throats formed by a piercing operation (FIG. 7), which can exhibit a different frequency response from, for example the secondary chamber(s). Thus, the resonator may be tuned to provide to the required frequency response.

Figure 8:
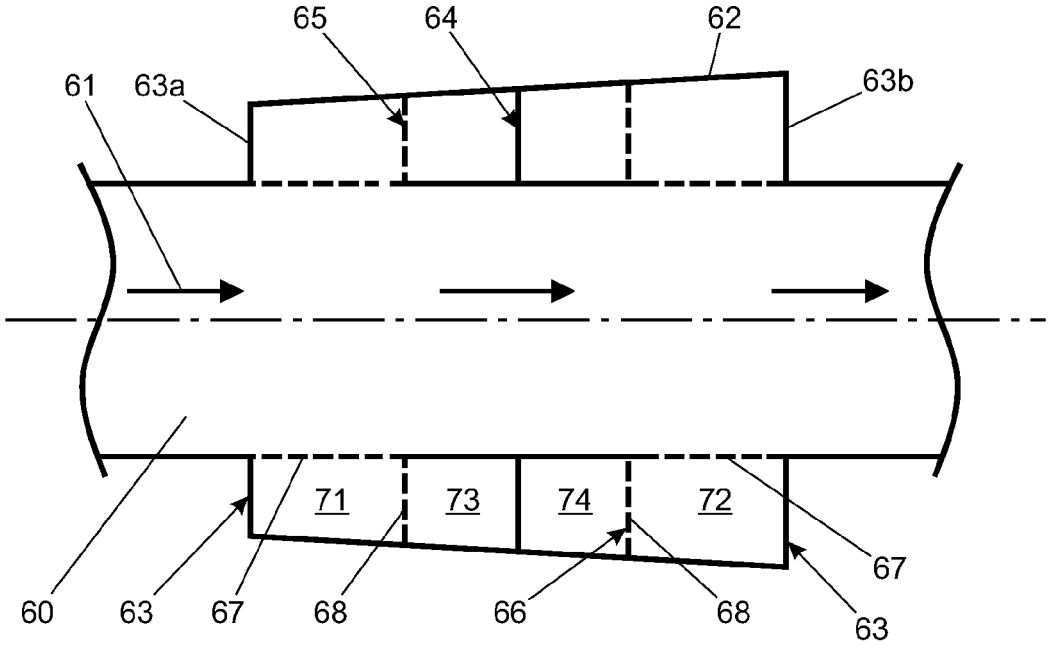
FIG. 8 illustrates in schematic cross-section a second embodiment of the invention.

FIG. 8 illustrates in schematic cross-section a second embodiment of the invention, comprising a supply duct (60) providing for unimpeded flow of air in the direction indicated by arrows (61). The attenuator comprises a tapered tubular drum (62) co-axial with the supply duct. The supply duct (60) and drum (62) are typically circular in section, but need not be.

The drum (62) has orthogonal end plates (63), and is divided into four chambers by an unapertured annular wall (64) and annular baffles (65, 66) on either side thereof.

The supply duct communicates with the end chambers (71, 72), which constitute primary chambers, via apertures (67), and each primary chamber (71, 72) communicates with an associated secondary chamber (73, 74) via openings (68). The secondary chambers (73, 74) are immediately adjacent, and separated by the solid wall (64) so as to be independent. Substantially no flow occurs through the apertures, though a small amount of turbulence may be expected in the vicinity thereof.

In one method of assembly the drum (62) is moulded of suitable plastics with the smaller end wall (63*a*). An unity plastics moulding comprising the supply duct (60), wall (64), baffles (65, 66) and larger end wall (63*b*) is inserted through the mouth of the drum and sealed thereto in any suitable manner, for example by ultrasonic welding or snap-fitting.

Each baffle may engage the internal surface of the drum by virtue of the taper or may seat against a rib; suitable sealant or adhesive may be provided if required.

The openings (68) need not be provided through the baffles, as illustrated, but may be in the form of cut-outs at the peripheral edge so as to form apertures upon assembly of the baffles in the enclosure. The cut-outs may be of regular symmetrical shape, such as 'C' or 'U' shapes, or may be irregular to suit the manufacturing process—what is required is that these cut-outs be of substantially the same cross-sectional area.

The variables provided by the second embodiment, to permit tuning, are as described in relation to the first embodiment, but additionally the primary and secondary chambers have slightly different resonance frequencies, which allows for super-position of the resonant frequency bands, and an enhanced effect.

Figure 9:
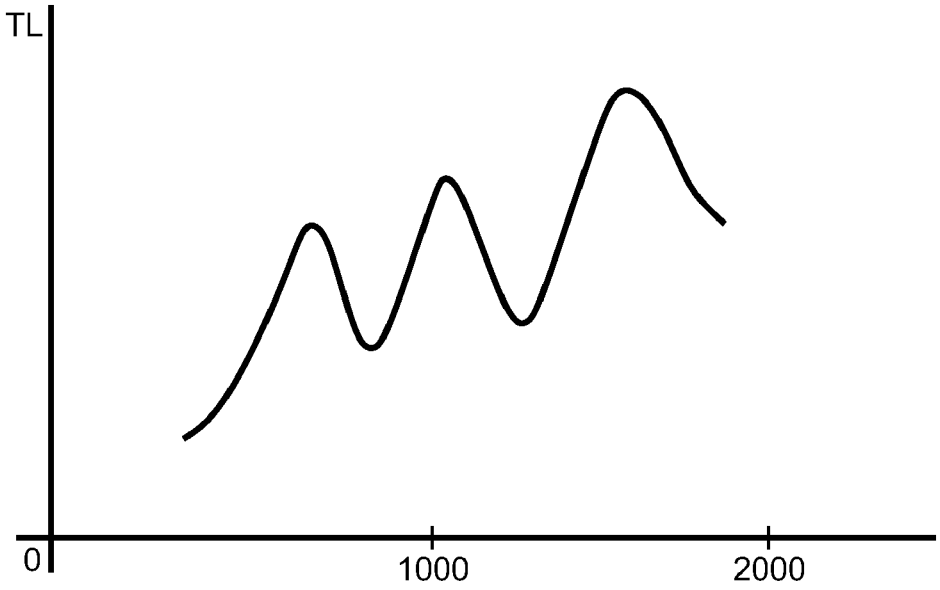
FIG. 9 shows graphically the frequency response of the second embodiment.

FIG. 9 shows a frequency response for the example of FIG. 8 having a supply duct internal diameter of 75 mm, a tapered enclosure enlarging from 98 mm internal diameter at one end to 109 mm internal diameter at the other end, and an overall length of 94 mm. The secondary chambers (73, 74) each have a length of 20 mm; the apertures (67) are 8×15 mm for each primary chamber; and the openings (68) are 8×9 mm for each chamber pair. Transmission loss is plotted against frequency in FIG. 9. Considerable variation in the size of apertures is possible; in another embodiment the apertures are 8×9 mm for the smaller chamber (71), and 4×9 mm for the larger chamber (72).

The individual responses of the large chamber pair (72, 74) comprises the attenuation peak at about 800 Hz. The attenuation peak of the smaller chamber pair (71, 73) is at 1000 Hz, and the combined effect comprises the peak at about 1500 Hz.

As noted above, these resonant frequencies can be tuned by adjusting the parameters of the attenuator, but without changing the space envelope defined thereby. The transmission loss (attenuation) may be increased by increasing the diameter of the configuration of FIG. 8 if space permits, but overall length need not be increased.

This embodiment is described with the secondary chambers immediately adjacent, but they could be outermost, with primary chambers axially within, or arranged one at the end and one towards the centre. These possibilities allow for further adjustment for tuning purposes.

Figure 10:
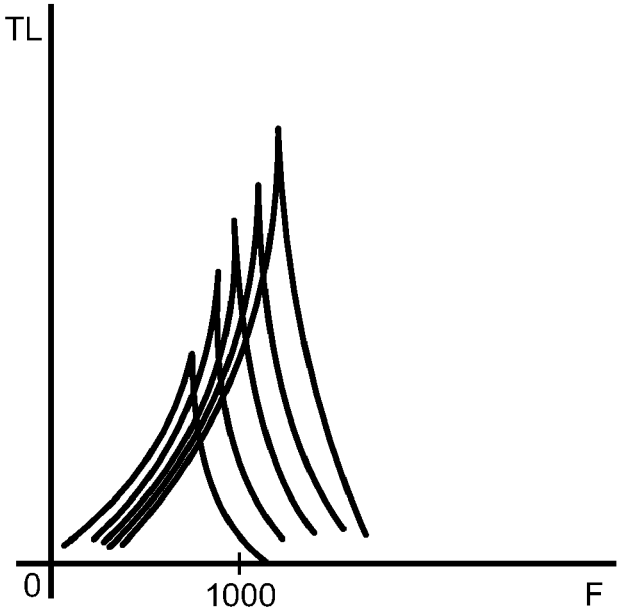
FIG. 10 shows graphically the effect of adjusting a parameter of the second embodiment.

An example of the possibilities for tuning is illustrated in FIG. 10, where the basic configuration of FIG. 8 is changed by progressively varying only the number of 15 mm apertures (67) from 2-8 for each primary chamber.

It can be observed that an attenuation peak can be moved, by this measure alone, from about 700 Hz to about 1300 Hz.

Figure 11:
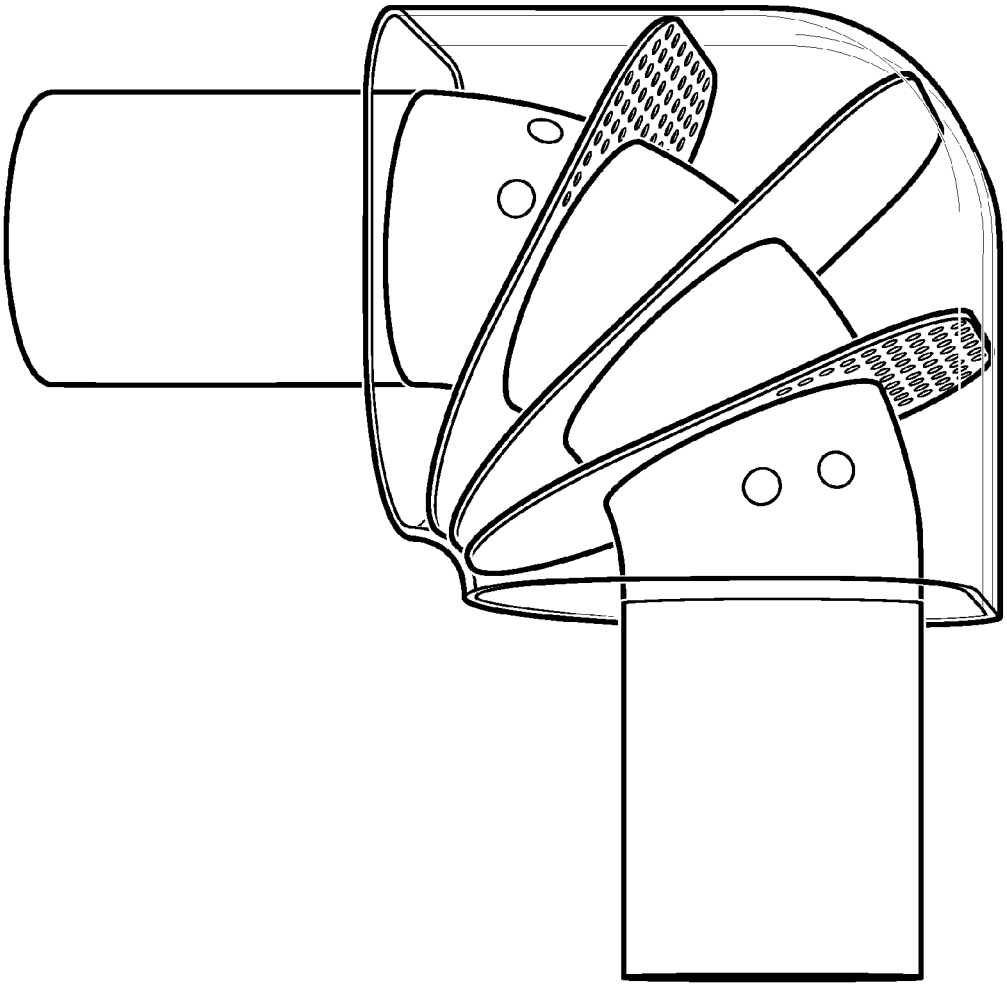
FIG. 11 is a perspective view through an attenuator according to another embodiment of the invention.

The attenuator of the present invention is not limited to use with a substantially straight or linear section of the air duct. On the contrary, an advantageous embodiment of the invention involves the attenuator being positioned at or close to a bend in the air duct. By way of example, FIG. 11 illustrates an arrangement in which the attenuator is positioned at a 90 degree bend in the air duct.

In this embodiment, the baffles are angled or inclined relative to each other in order to accommodate the change in direction of the air duct. In addition, the cross section of the attenuator housing is generally square or rectangular and the dimensions of the baffles differ according to their disposition within the housing. Such an arrangement, which does not differ materially from the arrangements described above in terms of its configuration and function, may facilitate packaging in certain applications.

While the present invention has been described with reference to application with an internal combustion engine, other, non automotive applications are also envisaged. The invention may provide useful noise attenuation in any system in which a fluid such as air passes through a duct and is not limited to the arrangement and use described herein.

The invention claimed is:

1. An attenuator for a fluid duct and comprising a tube having a wall, an inlet and an outlet, an enclosure surrounding the tube, and an annular baffle dividing the enclosure into primary and secondary chambers, wherein the interior of the tube is in fluid communication with the primary chamber via apertures in the tube wall, and the secondary chamber is in communication with the primary chamber via openings in the baffle, and wherein the secondary chamber is closed apart from the openings.

2. An attenuator according to claim 1, wherein the baffle is substantially orthogonal to the axis of the tube.

3. An attenuator according to claim 1, wherein the enclosure is substantially circular or oval in section.

4. An attenuator according to claim 1, wherein the enclosure is of substantially changing section in the direction of fluid flow through said tube.

5. An attenuator according to claim 1, wherein said openings are substantially equi-spaced about said tube.

6. An attenuator according to claim 1, wherein the total cross-sectional area of said apertures is greater than the total cross-sectional area of said openings.

7. An attenuator according to claim 1, wherein the maximum transverse dimension of said enclosure is less than three times the maximum transverse dimension of said tube.

8. An attenuator according to claim 1, wherein said apertures have substantially the same cross-sectional area, and each aperture has a cross-sectional area in the range 5-100mm$^2$.

9. An attenuator according to claim 1, wherein said openings have substantially the same cross-sectional area, and each opening has a cross-sectional area in the range 100-300mm$^2$.

10. An attenuator according to claim 1, and having a two baffles defining two secondary chambers, each being associated with a primary chamber.

11. An attenuator according to claim 10, wherein the secondary chambers are provided one on either side of a primary chamber.

12. An attenuator according to claim 10, and having two primary chambers.

13. An attenuator according to claim 12, wherein said primary chambers are at opposite ends of said enclosure.

14. An attenuator according to claim 10, wherein said secondary chambers have a different volume.

15. An attenuator according to claim 10, wherein each baffle has the same number and size of openings therein.

16. An attenuator according to claim 10, wherein said primary and secondary chambers have substantially the same length in the direction of fluid flow through said tube.

17. An attenuator according to claim 1, wherein said enclosure has a ratio of maximum axial and transverse dimensions of 5:1 or less.

18. An engine or a vehicle having an attenuator as claimed in claim 1.

* * * * *